United States Patent [19]

Staroba

[11] 3,997,011

[45] Dec. 14, 1976

[54] BUTTON DRILL BIT STRUCTURE

[76] Inventor: Otto R. Staroba, 299 Adelaide St. West, Toronto 2B, Ontario, Canada

[22] Filed: May 27, 1975

[21] Appl. No.: 580,608

[52] U.S. Cl. ..... 175/400; 175/410

[51] Int. Cl.[2] ..... E21C 13/08

[58] Field of Search ..... 175/410, 412, 413, 400; 228/2

[56] References Cited

UNITED STATES PATENTS

| | | | |
|---|---|---|---|
| 1,039,909 | 10/1912 | Decker | 175/413 |
| 1,388,490 | 8/1921 | Suman | 175/413 X |
| 3,571,905 | 3/1971 | Calton | 228/2 |
| 3,693,736 | 9/1972 | Gardner | 175/410 |

FOREIGN PATENTS OR APPLICATIONS

| | | |
|---|---|---|
| 269,103 | 3/1969 | U.S.S.R. |

*Primary Examiner*—Ernest R. Purser
*Assistant Examiner*—Richard E. Favreau

[57] ABSTRACT

The specification describes a rock bit of the button type comprising: a drill head body; a bit face part; a friction weld rigidly joining said bit face part to said body; a plurality of bores in the bit face part of said body extending substantially from the drill head body through said bit face part to exterior surfaces of the latter; insert cutters in certain of said bores, each of said cutters having a body portion within such bore and carrying an enlargement determining the outward limit of location of said cutter in said bore relative to said drill head body and defining with said bore and said drill head body a cavity beneath said insert cutter above said head and within said bit face part; and material extending into said cavity and supporting said insert cutter in said bore.

9 Claims, 5 Drawing Figures

BUTTON DRILL BIT STRUCTURE

This invention relates to a rock bit of the carbide button type in which the carbide buttons are securely locked to protect same against vibration and breakage leading to scoring and rapid deterioration of the bit face during use.

BACKGROUND OF THE INVENTION

Conventional carbide button rock bits are characterized by a cutter carrying generally in the form of a sleeve like-body adapted to be mounted on a drill rod the interior bore of which terminates at a head portion of high hardness and usually embodying coolant ducts or passages leading from the inner bore to exterior surfaces at the sides of the bit and in addition sometimes at the exterior central axis of the bit. So-called carbide buttons may have an exterior hemispherical shape or other shape and embody a mounting shank portion adapted to seat in a bore formed in the drill head, the same may be retained in same bore by brazing, silver soldering or the like and in some designs of such bits the metal of the head will be deformed around the margin of the bore holding the carbide button or insert to form a retaining lip tightly gripping the insert. In spite of all efforts such as described to retain the insert firmly in assembly with the head it is a common characteristic of such drill bits that one such button or insert may work loose sufficiently at an early stage of bit use to fracture or come loose, the free portion being thereby free to effect serious damage to the remainder of the buttons on the drill bit face. Accordingly, there is a need in this class of drill bit for the firm anchorage of carbide insert buttons in the bit face of the drill head body.

FIELD OF THE INVENTION

It is one of the objects of the present invention to provide a rock bit of the carbide insert button type in which the inserts are mounted through the bit face from within the bit body and are anchored therein by friction welding of a bit face body part to the drill head body thereby to achieve an interior welding connection superior to exterior deformation weldment connections of the prior art.

SUMMARY OF THE INVENTION

The rock bit of the invention comprises a drill head body having superposed thereon a drill head face part friction welded to said body; a plurality of bores in the bit face part of said body; a carbide insert cutter in each of said bores; and weld material derived from the friction welding of said head part to said body fastening said cutter within said head to said head and said bit face part.

BRIEF DESCRIPTION OF THE DRAWINGS

A preferred form of the invention is illustrated in the accompanying drawings in which it will be understood that the preferred mechanical arrangement may be subject to modification without departing from the spirit of the invention as defined by the claims forming a part of this specification.

In the drawings.

Figure 1:
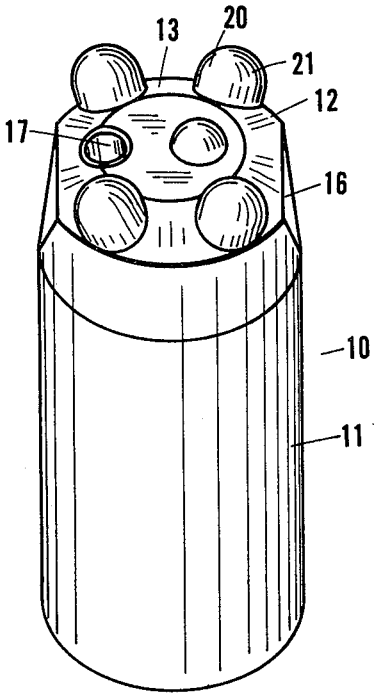
FIG. 1 is a perspective view of one preferred form of rock bit of the invention.

In the drawings the rock drill bit 10 of the invention comprises a drill head body 11 having superposed theron a drill head face part 12. The face part 12 has a working surface 13 opposed to the inner support surface 14, the latter being shown in FIG. 2 of a preferred concavity, it should be understood that such surfaces may be contained in a single plane and may be concave or may be convex it being merely convenient in the preferred form of the invention shown that the surfaces 14 are of a generally concave nature adapted to seat over corresponding convex surfaces 15 of head body part 11. The head face part 12 may be grooved or cut away such as at 16 to provide for entrapment of eflux of lubricant in a drill hole, said lubricant being provided by a suitable bore 17 in said face part 12 communicating with a bore 18 of the head body 11 in turn extending from a central bore 19 of body 11. It will be observed that in the drawing of FIG. 2, two such coolant passages 17 and 18 are revealed. The particular design and array of coolant passages is not critical to the drill bit of the invention and may be dictated by well-known practise in the art.

The separate drill head face part 12 is a particular feature of the invention having regard to the manner of mounting the cutters 20 therein in association with the manner of fastening the bit face part 12 to the body 11 according to this invention.

Figure 3:
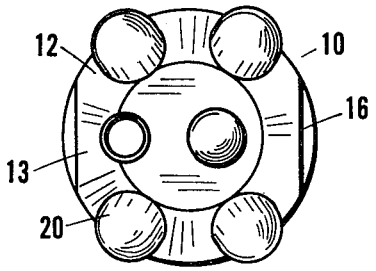
FIG. 3 is a plan view of the rock bit of FIG. 1.
Figure 2:
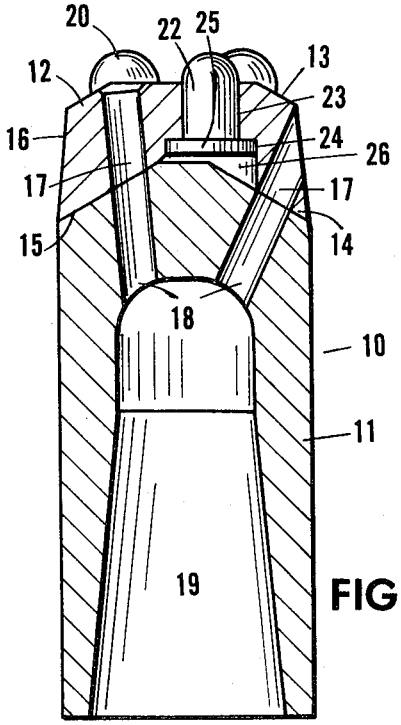
FIG. 2 is a sectional view on the line 2—2 of FIG. 1.

Any select array carbide insert cutters 20 may be selected by the designer of a drill bit according to the invention having regard to a desired extension thereof from the work surface 13 it being understood that such cutters regardless of the specific shape of the work surface 13 must extend forwardly and outwardly therefrom substantially in the manner shown in FIGS. 1, 2 and 3. According to the invention, each of said cutters 20 has a free shaped cutting terminus or end 21 such as in the hemispherical shape shown and forming a part of cylindrical cutter body 22 supported in a close fitting bore 23 in said bit face part 12. Especially, however, the back or underside of each bore 23 preferably embodies a relieved or countersunk portion or socket 24 adapted to receive an enlargement or flange portion 25 of each cutter body 22 thus to determine the outward limit of positioning of said cutter on said drill head face part 12.

While attempts have been made heretofore to weld a carbide cutter into a bore from an exterior surface direction, the endurance of such a connection in service has not been other than ordinary. According to the invention however, the face part 12 while carrying the insert cutters preferably in press fit relationship thereto is spun onto the body 11 by friction welding, sometimes known in the art by the term an "inertia welding process" in which one work piece is fixed in a stationary welding device and the other being clamped in a spindle chuck is accelerated rapidly until a predetermined speed is achieved at wich one part is thrust against the other as a result of which friction between the parts converts stored energy of rotation to frictional heat thus to effect interface welding of the parts such that just prior to cessation of rotation the two part bond and the remaining energy hot works the metal interface. The hot working aspect of such well known process causes the expansion of hot metal into any cavity such as the cavity 26 behind the flange 25 and surface 15, thus expelling any impurities or voids providing a refined grain structure and fully filling such gap 26 to support and anchor each of the cutters 20 in the drill head face part 12 relative to body 11.

Figure 4:
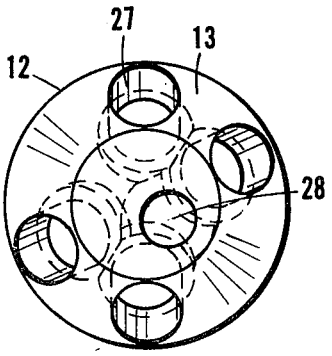
FIG. 4 is a plan view of a separate drill head body face part according to the invention.
Figure 5:
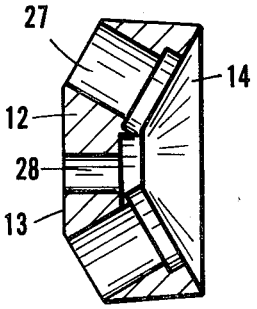
FIG. 5 is a sectional view on the line 5—5 of FIG. 4.

In FIG. 4 is shown a plan view of a typical drill head face part 12 in which the divergent bores 27 are arranged at other than uniform arcuate spacing about a centre region bore 28 located eccentrically. It has been found that uniform non-axially aligned geometry of colour array it to be preferred in carbide button type drill head rock bit cutters of the invention, thus to achieve a presentation of a higher exposed area of cutter face to cutting action at all times. It will be understood that while the cutter bodies 22 have been indicated as of cylindrical form with a base flange structure 25, the same could be provided in an outwardly converging tapered form. Generally, however, tapered form is more difficult to locate accurately in the drill head face part to achieve a predetermined exposed height or surface area thereof above and beyond the work face 13 of the drill head face part 12. The invention however does contemplate the practical alternative of utilizing a low carbon tungsten steel alloy for the drill head face part adapted to be taper bored for the insert of a tapered cutter therein by hot or cold working to a predetermined position, thereafter to be backed up such as in a gap 26 by weld material obtainable from the conventional friction welding process herein referred to but previously not applied to construction of drill bits in the manner of the invention.

What is claimed is:

1. A rock bit of the button type comprising: a drill head body; a bit face part; a friction weld solely and rigidly joining said bit face part to said body; a plurality of bores in the bit face part of said body extending substantially from the drill head body through said bit face part to exterior surfaces of the latter; insert cutters in certain of said bores, each of said cutters having a body portion within such bore and carrying an enlargement determining the outward limit of location of said cutter in said bore relative to said drill head body and defining with said bore and said drill head body a cavity beneath said insert cutter above said head and within said bit face part; and weld material extending into said cavity and supporting said insert cutter in said bore.

2. A rock bit as claimed in claim 1 in which the interface between the drill head body and the drill bit face part converges outwardly from said drill head body to said bit face part.

3. The rock bit of claim 1 in which said carbide insert cutters each comprises a hemispherical cutter outward end portion rising from a cylindrical cutter body and a retaining flange on said cutter body defining the other end thereof, an enlarged bore portion in each of said cutter bores of said bit face part and adapted to receive each cutter flange and to define said cavity with the latter relative to said drill head body.

4. A rock bit as claimed in claim 1 in which the interface between the drill head body and drill head face part converges outwardly from said drill head body to said bit face part, and in which said insert cutters each comprise a hemispherical cutter outward end portion rising from a cylindrical cutter body and a retaining flange on said cutter body defining the other end thereof; and an enlarged bore portion in each of said cutter bores of said face part and adapted to receive each cutter flange and to define said cavity with the latter relative to said drill head body.

5. The rock bit of claim 1 and a generally converging working face on said bit face part; and at least one coolant passage extending from said working face through said bit face part into said drill head body; the latter having a central chamber communicating with said passage.

6. The rock bit of claim 1 in which the insert cutters are arranged in non-uniform geometric array on said bit face part to provide a substantially independent cutting action for each of said cutters.

7. The rock bit of claim 1 in which the cutters are press fit into the bores of the bit face part from the direction of said drill head body toward the bit face part.

8. The bit of claim 1 in which said material forms a part of said friction weld.

9. A rock bit of the button type comprising: a drill head body; a bit face part; a friction weld solely and rigidly joining said bit face part to said body; and plurality of bores in the bit face part of said body extending substantially from the drill head body through said bit face part to exterior surfaces of the latter; carbide insert cutters in certain of said bores, each of said cutters having a body portion within such bore and carrying an enlargement determining the outward limit of location of said cutter in said bore relative to said drill head body and defining with said bore and said drill head body a cavity beneath said insert cutter above said head and within said bit face part; and material forming a part of said friction weld extending into said cavity and supporting said insert cutter in said bore.

* * * * *